US005762476A

United States Patent [19]

Ota et al.

[11] Patent Number: 5,762,476

[45] Date of Patent: Jun. 9, 1998

[54] VARIABLE CAPACITY SINGLE-HEADED PISTON REFRIGEMENT COMPRESSOR

[75] Inventors: Masaki Ota; Sokichi Hibino; Hisakazu Kobayashi; Masahiro Kawaguchi; Ken Suitou; Shinichi Ogura; Takuya Okuno, all of Kariya, Japan

[73] Assignee: Kabushiki Kaisha Toyoda Jidoshokki Seisakusho, Kariya, Japan

[21] Appl. No.: 552,514

[22] Filed: Nov. 9, 1995

[30] Foreign Application Priority Data

Nov. 11, 1994 [JP] Japan ..... 6-278069
Aug. 16, 1995 [JP] Japan ..... 7-208722

[51] Int. Cl.[6] ..... F04B 1/29

[52] U.S. Cl. ..... 417/222.2; 417/295

[58] Field of Search ..... 417/269, 295, 417/222.2, 222.1

[56] References Cited

U.S. PATENT DOCUMENTS

| | | | |
|---|---|---|---|
| 4,135,862 | 1/1979 | Degawa | 417/269 |
| 4,321,019 | 3/1982 | Degawa et al. | 417/269 |
| 4,691,526 | 9/1987 | Kobayashi et al. | 417/295 |
| 5,017,096 | 5/1991 | Sugiura et al. | 417/295 |
| 5,173,032 | 12/1992 | Taguchi et al. | 417/495 |
| 5,577,894 | 11/1996 | Kawaguchi et al. | 417/295 |

FOREIGN PATENT DOCUMENTS

| | | | |
|---|---|---|---|
| 62-674 | 1/1987 | Japan . | |
| 62-276279 | 12/1987 | Japan . | |
| 1-138381 | 5/1989 | Japan | 417/222.2 |
| 337378 | 2/1991 | Japan . | |

*Primary Examiner*—Timothy Thorpe
*Assistant Examiner*—Peter G. Korytnyk
*Attorney, Agent, or Firm*—Burgess, Ryan & Wayne

[57] ABSTRACT

A variable capacity single-headed piston type compressor having a cylinder block defining therein a plurality of cylinder bores in which single-headed pistons are reciprocated so as to compress refrigerant gas in response to a rotation of rotation-to-reciprocation converting unit arranged in a crank shaft defined by the cylinder block and a front housing hermetically attached to a front end of the cylinder block, the crank chamber being provided with a suction gas inlet port formed so as to open into the crank chamber, a rear housing hermetically attached to a rear end of the cylinder block and defining a suction chamber for the refrigerant gas before compression and a discharge chamber for the refrigerant gas after compression, the suction chamber being in fluid communication with the crank chamber so as to receive the refrigerant gas from the crank chamber via a fluid passageway for the suction of the refrigerant gas, and a flow regulating valve arranged in the fluid passageway to adjustably change the cross-sectional area of the fluid passageway to thereby control the pressure in the suction chamber.

16 Claims, 6 Drawing Sheets

VARIABLE CAPACITY SINGLE-HEADED PISTON REFRIGEMENT COMPRESSOR

BACKGROUND OF THE INVENTION

1. Field of the Invention

The present invention relates generally to a variable capacity type refrigerant compressor with single-headed reciprocating pistons, suitable for being incorporated into a refrigerating system or a climate control system for an automobile. More particularly, the present invention relates to a single-headed piston type variable capacity compressor having an internal construction improved so as to increase the operational reliability of the compressor, and provided with either a solenoid clutch type transmission unit or a non-clutch type transmission unit therein for receiving a drive power from, for example, an automobile engine.

2. Description of the Related Art

Many variable capacity refrigerant compressors, such as swash-plate operated single headed piston type compressors, and wobble-plate operated single headed piston type compressors, are used for compressing refrigerant gas for a refrigerating system or a climate control system accommodated in an automobile. In the variable capacity refrigerant compressor, an axial drive shaft rotated about an axis of rotation thereof rotates a plate-like rotation-to-reciprocation converting element including an inclination-changeable swash plate, and a combination of a rotatable drive plate and a non-rotatable wobble plate, for causing reciprocation of a plurality of single-headed pistons. The plate-like rotation-to-reciprocation converting element is mounted on or around the axial drive shaft and housed in a crank chamber defined by a front housing attached to a cylinder block in which a plurality of cylinder bores are formed around the axis of rotation of the drive shaft. Pressure prevailing in the crank chamber is adjustably changed so as to cause a change in pressure acting on the back of the single-headed pistons of which the head is subjected to refrigerant gas pressure, to thereby control an angle of inclination of the rotation-to-reciprocation converting plate element, and in turn, the stroke of reciprocation of the plurality of single-headed pistons. As a result, the capacity of the compressor, i.e., the capacity of the refrigerant gas compressed and discharged by the compressor is adjustably varied. The above-mentioned adjustable change in the pressure prevailing in the crank chamber is controlled by a capacity control valve capable of operating so as to supply a part of the compressed high pressure refrigerant gas from the discharge chamber of the compressor to the crank chamber, in response to a change in the suction pressure of the refrigerant gas.

Japanese Unexamined Patent Application Publication No. 3-37378 (JP-A-3-37378) discloses a variable capacity single-headed piston type refrigerant compressor having a non-clutch type transmission unit mounted on the drive shaft of the compressor. In the compressor of JP-A-3-37378, a conventional solenoid clutch type transmission unit for electro-magnetically controlling connection and disconnection of a drive power from an automobile engine to the drive shaft is not employed. Thus, the elimination of the solenoid clutch type transmission unit can show a great contribution to an improvement in the driving feeling of an automobile, reduction in the weight of the refrigerant compressor and curtailment of cost for manufacturing the compressors.

Nevertheless, in the variable capacity single-headed compressor with a non-clutch type transmission unit, the drive shaft is constantly rotated to thusly deliver a minimum amount of compressed gas toward the airconditioning or climate control system even when the refrigeration of air is not required. Accordingly, a problem of frosting the heat exchanging surface of an evaporator of the climate control system occurs. Therefore, a particular solenoid valve is incorporated in a refrigerant gas introductory circuit from the climate control system toward the compressor, in order to immediately stop the flowing of the refrigerant gas into the suction chamber of the compressor from the climate control circuit when the refrigeration of the air is not required, to thereby stop delivery of the compressed refrigerant gas from the compressor toward the climate control system via a refrigerant gas delivery circuit from the compressor toward the climate control system. However, the use of the solenoid valve to control the introduction of the suction refrigerant gas into the suction chamber of the compressor generates such a problem that a sudden stopping of the suction refrigerant gas introduction as well as a sudden restarting of the introduction of the suction gas cause a large change in the drive torque of the compressor resulting in the appearance of uncomfortable drive feeling of an automobile mounting therein the compressor, and accordingly, the provision of the non-clutch type transmission unit for the compressor becomes meaningless.

On the other hand, with the variable capacity refrigerant compressor having either a solenoid clutch type transmission unit or a non-clutch type transmission unit, the crank chamber of the compressor is hermetically sealed to allow accurate control of the pressure prevailing in the crank chamber. The hermetically sealed crank chamber of the compressor is often subjected to the high pressure of the blow-by gas leaking from the cylinder bores of the compressor, and when a large capacity operation of the compressor delivering a large amount of compressed refrigerant gas is carried out, the interior of the crank chamber is exposed to a very high pressure condition. Accordingly, a shaft sealing means arranged for the sealing the end of the drive shaft such as a lip seal is apt to be damaged in a short operating time, and various internal moving elements of the compressor are rapidly abraded. Thus, in the recent variable capacity single-headed piston type compressor, the rotation-to-reciprocation converting element is made of an expensive abrasion-resistant material, and also a high cost surface hardening treatment is often applied to the surface of the rotation-to-reciprocation converting element for solving the problem of abrasion. Consequently, the manufacturing cost of the variable capacity single-headed piston type compressor becomes high.

Further, the variable capacity single-headed piston type compressor has such a defect that during a small discharge capacity operation of the compressor, pulsation in the suction pressure of the refrigerant gas sucked into the compressor is large, and accordingly, a pulsating noise appears from the evaporator. In order to prevent the appearance of the pulsating noise, there has been proposed to provide a damping chamber for deadening the suction pressure pulsation in the rear housing of the compressor.

SUMMARY OF THE INVENTION

Therefore, an object of the present invention is to provide a variable capacity single-headed piston type refrigerant compressor provided with an internal construction improved so as to enhance the operation reliability of the compressor while reducing the generation of noise due to pulsation of the suction pressure when the compressor is used with a refrigerating or climate control system for automobiles.

Another object of the present invention is to provide a variable capacity single-headed piston type refrigerant compressor provided with a non-clutch type transmission unit and a simple and novel internal arrangement for smoothly stopping and restarting the circulating flow of the refrigerant gas in the region of a minimum capacity operation of the compressor.

In accordance with one aspect of the present invention, there is provided a variable capacity single-headed piston type compressor suitable for being incorporated in an external refrigerating system including:

a cylinder block having axial front and rear ends, and defining a plurality of axial cylinder bores therein around a central axis thereof;

a front housing hermetically attached to the front end of the cylinder block so as to define a crank chamber therein;

a rear housing hermetically attached to the rear end of the cylinder block so as to define therein a suction chamber for refrigerant gas before compression and a discharge chamber for the refrigerant gas after compression;

an axial drive shaft rotatably supported in the front housing and the cylinder block for being rotated about an axis of rotation thereof, the axial drive shaft having a front end receiving a drive power thereat;

a plurality of single-headed pistons slidably received in the plurality of cylinder bores for implementing suction, compression and discharge of the refrigerant gas;

a rotation-to-reciprocation converting plate-like means arranged to be rotated together with the drive shaft and provided with a plate portion angularly inclined from a plane perpendicular to the axis of rotation of the axial drive shaft, and changing an angle of inclination thereof in response to a change in a differential between pressures prevailing in the crank chamber and the suction chamber, the rotation-to-reciprocation converting plate-like means being operatively connected to the plurality of single-headed pistons to thereby generate reciprocation of the pistons;

a suction gas inlet means for providing a fluid connection between the crank chamber and the external refrigerating system so as to introduce the refrigerant gas before compression directly into the crank chamber from the external refrigerating system;

a discharge gas outlet means for providing a fluid connection between the discharge chamber and the external refrigerating system so as to deliver the refrigerant gas after compression, toward the refrigerating system;

a fluid passageway means internally extending between the crank chamber and the suction chamber for providing a constant fluid connection therebetween, the fluid passageway means including at least one port portion formed therein to have a predetermined cross-sectional area; and a flow regulating valve means disposed in the fluid passageway means and cooperating with the port portion of the fluid passageway means so as to regulate the cross-sectional area of the port portion with respect to the predetermined cross-sectional area thereof to thereby adjustably change the pressure prevailing in the suction chamber.

The variable capacity single-headed piston type compressor may incorporate a pressure-responsive capacity control valve means which has a constant fluid interconnection with the discharge chamber of the rear housing and is able to control a differential between the pressure in the crank chamber and the pressure in the suction chamber in response to a change in a refrigerating load applied to the external refrigerating system. Then, preferably, the pressure-responsive capacity control valve means is fluidly connected to the flow regulating valve means so as to apply a pressure of the refrigerant gas after compression to the flow regulating valve means to thereby actuate the flow regulating valve means in such a manner that the pressure prevailing in the suction chamber is adjustably changed in response to the change in the refrigerating load.

Preferably, the flow regulating valve means comprises a spool valve element movably arranged adjacent to the port portion of the fluid passageway means and having a pressure receiving end thereof for receiving the pressure of the refrigerant gas after compression, the spool valve element adjustably changing the cross-sectional area of the port portion of the fluid passageway means with respect to the predetermined cross-sectional area thereof.

Preferably, the variable capacity single-headed piston type compressor further comprises an additional fluid passage means arranged internally between the pressure-responsive capacity control valve means and the crank chamber, for circulating a part of the refrigerant gas after compression from the discharge chamber into the crank chamber via the pressure-responsive capacity control valve means.

The discharge gas outlet means preferably comprises a differential-pressure-operated valve means which can prevent the refrigerant gas after compression from flowing from the discharge chamber toward the external refrigerating circuit when the rotation-to-reciprocation converting plate-like means is moved to a position whereat reciprocating stroke of each of the plurality of single-headed pistons is at the minimum stroke thereof.

The rotation-to-reciprocation converting means may be either a wobble plate type rotation-to-reciprocation converter including a combination of a swash plate rotating together with the drive shaft and a non-rotatable wobble plate operatively connected to the respective pistons via respective connecting rods, or a rotating swash plate type rotation-to-reciprocation converter including a swash plate element rotating together with the drive shaft and operatively connected to the respective pistons via respective shoe elements.

In accordance with another aspect of the present invention, there is provided a variable capacity single-headed piston type compressor suitable for being incorporated in an external refrigerating system including:

a cylinder block having axial front and rear ends and defining a plurality of axial cylinder bores therein around a central axis thereof;

a front housing hermetically attached to the front end of the cylinder block so as to define a crank chamber therein;

a rear housing hermetically attached to the rear end of the cylinder block so as to define therein a suction chamber for refrigerant gas before compression and a discharge chamber for the refrigerant gas after compression;

an axial drive shaft rotatably supported in the front housing and the cylinder block for being rotated about an axis of rotation thereof, and having a front and to receive drive power;

a plurality of single-headed pistons slidably received in the plurality of cylinder bores for implementing suction, compression and discharge of the refrigerant gas;

a rotation-to-reciprocation converting plate-like means arranged to be rotated together with the drive shaft and provided with a plate portion angularly inclined from a plane perpendicular to the axis of rotation of the axial drive shaft, and changing an angle of inclination thereof in response to a change in a differential between pressures prevailing in the crank chamber and in the suction chamber, the rotation-to-reciprocation converting plate-like means being operatively connected to the plurality of single-headed pistons so as to reciprocate the pistons;

a suction gas inlet means for providing a fluid connection between the crank chamber and the external refrigerating system so as to introduce the refrigerant gas, before compression, directly into the crank chamber from the external refrigerating system;

a discharge gas outlet means for providing a fluid connection between the discharge chamber and the external refrigerating system so as to deliver the refrigerant gas, after compression, toward the refrigerating system;

a first fluid passageway internally extending between the crank chamber and the suction chamber for providing a constant fluid connection therebetween, the first fluid passageway including at least one port portion formed therein to have a predetermined cross-sectional area; and a spool type flow regulating valve disposed movably in the first fluid passageway and cooperating with the port portion of the first fluid passageway so as to adjustably reducing the cross-sectional area of the port portion with respect to the predetermined initial cross-sectional area thereof to thereby adjustably change a pressure prevailing in the suction chamber, the spool type flow regulating valve having a mechanical means for stopping the movement thereof at a position where the port portion has a predetermined reduced cross-sectional area with respect to the initial cross-sectional area;

a solenoid valve arranged in a second fluid passage way extending between the discharge chamber and the spool type flow regulating valve for controlling the supply of the pressure of the refrigerant gas after compression from the discharge chamber toward the spool type flow regulating valve in response to a control signal provided by the external refrigerating system;

a third fluid passageway extending between the second fluid passageway and the crank chamber, for providing a fluid communication between the discharge chamber and the crank chamber via the solenoid valve; and a differential-pressure-operated valve means arranged in the discharge gas outlet means, for preventing the refrigerant gas, after compression, from flowing from the discharge chamber toward the external refrigerating circuit when the rotation-to-reciprocation converting plate-like means is moved to a position whereat the reciprocating stroke of each of the plurality of single-headed pistons is the smallest stroke thereof.

The variable capacity single-headed piston type compressor may further comprise a pressure-responsive capacity control valve arranged in the second fluid passageway for supplying the pressure of the refrigerant gas, after compression, to the spool type flow regulating valve in response to a change in refrigerating load applied to the external refrigerating system.

Preferably, the third fluid passageway is provided with two opposite ends, one being connected to the second fluid passageway adjacent to the solenoid valve, and the other being connected to the crank chamber at a position adjacent to a shaft seal unit mounted on the axial drive shaft and fluidly sealing the crank chamber.

Further preferably, the first fluid passageway is formed so as to extend through the cylinder block.

BRIEF DESCRIPTION OF THE DRAWINGS

The above and other objects, features, and advantages of the present invention will be made more apparent from the ensuing description of the preferred embodiments thereof, in conjunction with the accompanying drawings wherein.

DESCRIPTION OF THE PREFERRED EMBODIMENTS

Figure 1:
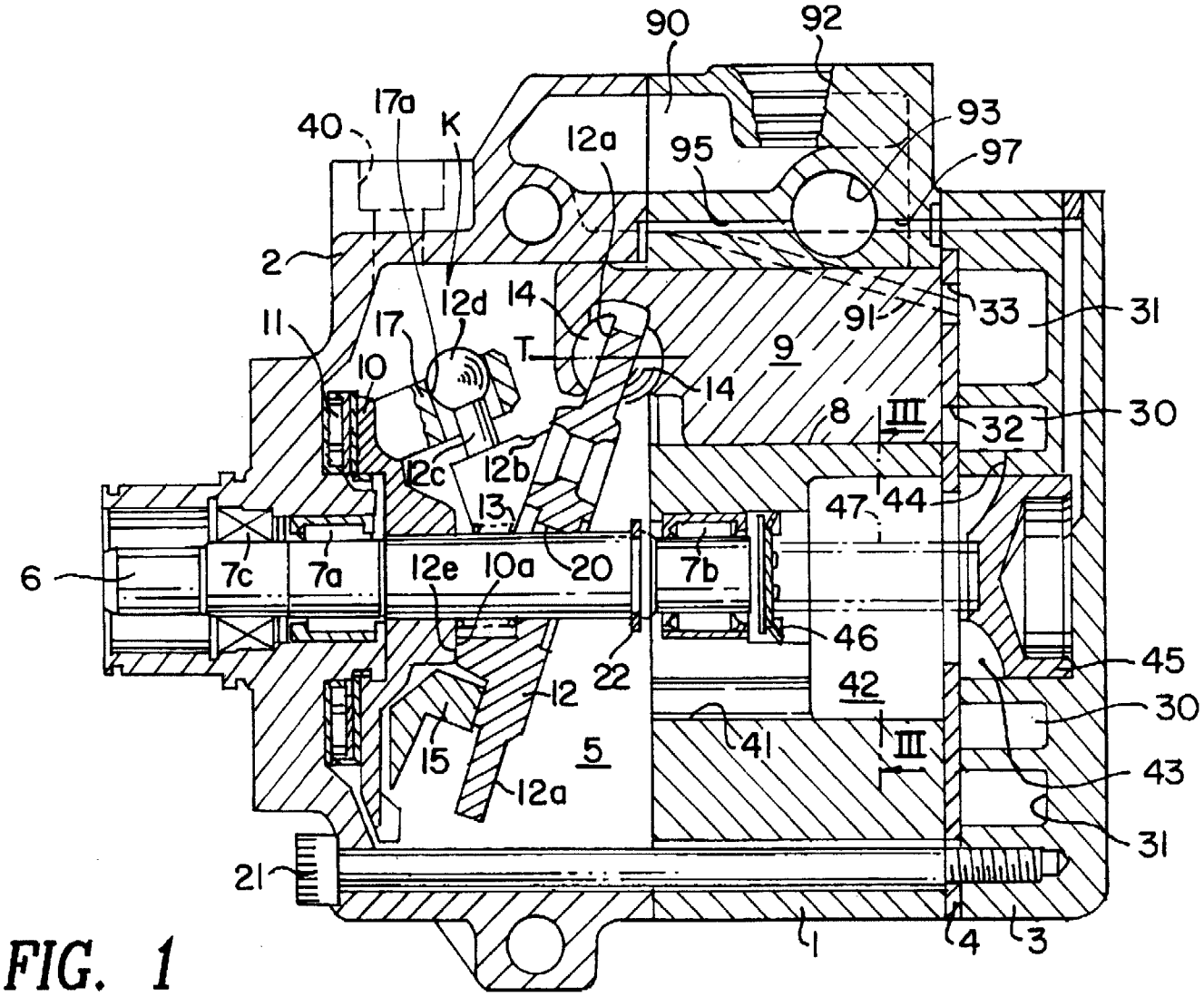
FIG. 1 is a longitudinal cross-sectional view of a variable capacity single-headed piston type refrigerant compressor according to an embodiment of the present invention.

It should be understood that throughout the drawings illustrating various embodiments of the present invention, the same or like elements, parts and units are designated by the same reference numerals or the same reference numerals with alphabetic suffixes. Further, since all of the refrigerating circuits according to various embodiments of the present invention employ a variable capacity type compressor for compressing a refrigerant gas, it will simply be referred to as a compressor.

Figure 2:
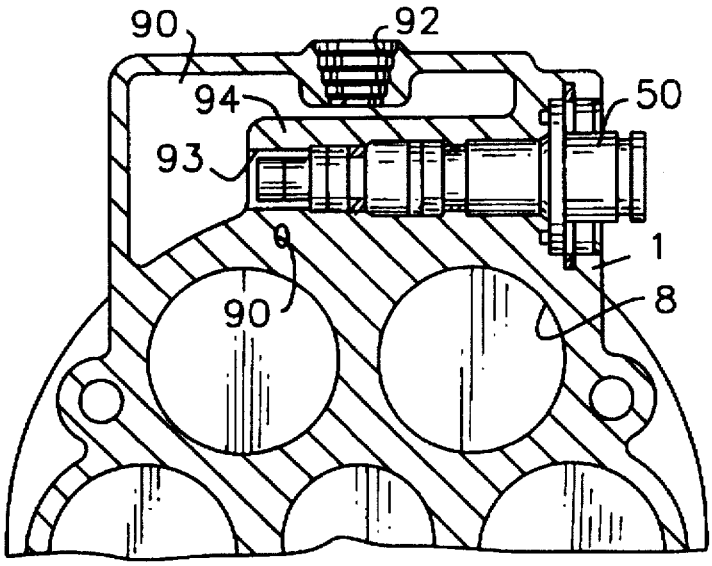
FIG. 2 is a cross-sectional view of a part of the compressor of FIG. 1, illustrating a damping chamber formed in the front housing and the cylinder block.
Figure 3:
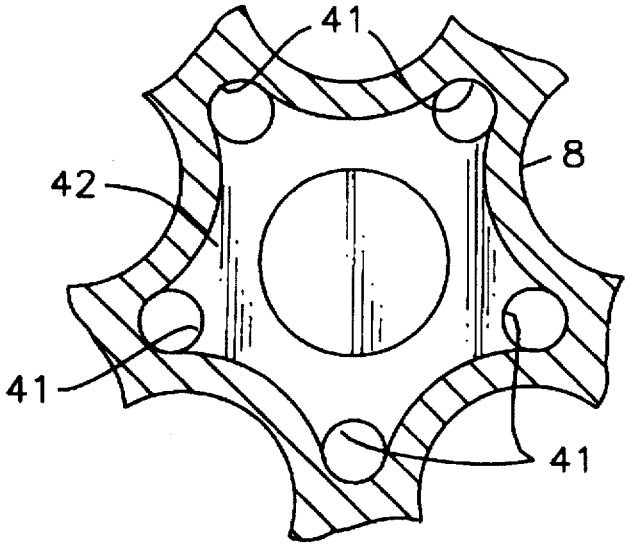
FIG. 3 is a cross-sectional view taken along the line III—III of FIG. 1, illustrating a fluid suction passageway of the compressor.

Referring to FIGS. 1 through 3, the compressor of the first embodiment includes a cylinder block 1 having an axial front end closed by a front housing 2, and an axial rear end closed by a rear housing 3 via a valve plate 4. The front housing 2, the cylinder block 1, and the rear housing 3 are axially combined together by a plurality of long bolts 21 respectively having a screw end threadedly engaged in the threaded bore formed in the rear housing 3. The cylinder block 1 and the front housing 2 define a closed crank chamber 5 in which a drive shaft 6, supported by the front housing 2 and the cylinder block 1, axially extends. The axial drive shaft 6 is rotatably received by front and rear anti-friction bearings **7*a* and 7*b* which are fitted in bearing bores of the front housing 2 and the cylinder block 1, so that the drive shaft 6 has a central axis of rotation thereof. The front end of the drive shaft 6 extends beyond a shaft seal unit 7*c*** toward the exterior, and is connectable to e.g., an automobile engine (an external drive power source) via a solenoid clutch type power transmission mechanism (not shown).

The cylinder block 1 is provided with a plurality of axial cylinder bores 8 arranged equiangularly around the axis of rotation of the drive shaft 6, and a plurality of single-headed pistons 9 are fitted in the respective cylinder bores 8 and can reciprocate therein. A rotor 10 is mounted on the drive shaft 6 in the crank chamber 5, so as to rotate together with the shaft 6, and is axially supported by a thrust bearing 11 seated at an inner end of the front housing 2. A swash plate 12 is mounted around the drive shaft 6 behind the rotor 10, and is axially constantly biased rearward by a compression spring 13 arranged between the rotor 10 and the swash plate 12. The swash plate 12 has two flat annular faces 12*a* extending circumferentially at the periphery thereof, and the two flat annular faces 12*a* of the swash plate 12 are slidably engaged with flat faces of half-spherical shoes 14 which have round faces received in round recesses in the pistons 9.

The swash plate 12 is provided with a pair of brackets 12*b* formed in a radially inward portion of a front face of the plate 12, and the pair of brackets 12*b* are connected to a pair of guide pins 12*c* each having a ball 12*d* at an end thereof. The balls 12*d* of the guide pins 12*c* are movably fitted in bores 17*a* formed in a pair of later-described arms 17 extending from a part of the rotor 10. The above-mentioned brackets 12*b*, the guide pins 12*c*, and the balls 12*d* of the swash plate 12 function as a hinge mechanism K for pivotally connecting the swash plate 12 to the rotor element 10.

Further, the swash plate 12 is centrally provided with a curved through-bore 20 by which the swash plate 12 can perform a pivotal motion for changing an angle of inclination thereof with respect to a plane perpendicular to the axis of rotation of the drive shaft 6. Thus, the swash plate 12 ordinarily inclining from the above-mentioned plane is provided with a top dead center position thereof at a position designated by "T", and a bottom dead center thereof spaced 180° away from the top dead center position "T". The above-mentioned hinge mechanism K is arranged adjacent to the top dead center position "T" of the swash plate 12. The swash plate 12 is provided with a counterweight 15 rivetted to the front face of the swash plate at a position adjacent to the bottom dead center of the swash plate 12. The counterweight 15 extends radially from a central portion of the front face toward the periphery of the swash plate 12 so as to balance the weight of the hinge mechanism "K" during rotation of the swash plate 12 and the rotor 10. Furthermore, the swash plate 12 is centrally provided with a front end face 12*e* acting as a stop abutting against a predetermined rear face of the rotor 10 and determining the maximum angle of inclination of the swash plate 12.

The minimum angle of inclination of the swash plate 12 is determined when a central recess formed in the rear face of the swash plate 12 comes into engagement with a circlip 22 mounted on a predetermined position of the drive shaft 6.

The rotor 10 is provided with the above-mentioned pair of arms 17 extending rearward from a portion of the rotor 10 toward the afore-mentioned guide pins 12*c* of the swash plate 12. The pair of arms 17 are formed with a pair of guide through-bores 17*a* in which the balls 12*d* of the hinge mechanism K is smoothly fitted, so that the swash plate 12 hinged to the rotor 10 is permitted to stably pivot about the center of the balls 12*d* of the hinge mechanism K when the swash plate 12 changes its angle of inclination. The hinge mechanism K and the guide through-bores 17*a* are provided and set so that the top dead center of respective pistons 9 is unchanged even if the swash plate 12 changes its angle of inclination.

The compressor of FIG. 1 is characterized in that the suction system for introducing refrigerant gas, returned from an external refrigerating system or a climate control system, into the interior of the compressor body is very different from that of the conventional variable capacity single-headed piston type compressor.

The variable capacity single-headed piston type compressor of FIG. 1 is provided with a suction gas inlet port 40 formed in a part of the front housing 2 so as to open into the crank chamber 5. The suction gas inlet port 40 is connected, via a fluid conduit (not shown), to the external refrigerating system so as to directly introduce refrigerant gas, from the refrigerating system, into the crank chamber 5 which can function so as to not only receive the refrigerant gas to be compressed, but also damp suction pressure pulsations in the refrigerant gas as soon as the refrigerant gas is introduced into the crank chamber 5.

The crank chamber 5 fluidly communicates with the suction chamber 30 through a first fluid passageway, which includes a plurality of axial through-hole-like passages 41 formed in the cylinder block 1 and arranged between respective two neighboring cylinder bores 8, a central chamber 42 recessed in the end of the cylinder block 1 so as to be directly connected to the plurality of through-hole-like passages 41, a bottomed valve chamber 43 centrally formed in the rear housing 3 to have a cylindrical wall, and constantly communicated with the central chamber 42 via a large through-bore formed in the valve plate 4, and a plurality of ports 44 provided in the cylindrical wall of the bottomed valve chamber 43 for fluidly communicating between the valve chamber 43 and the suction chamber 30.

The rear housing 3 is provided with an annular discharge chamber 31 arranged so as to surround the suction chamber 30, and is isolated from the suction chamber 30 via a circumferentially extending wall.

The valve plate 4 is provided with a plurality of suction ports 32 providing a communication between the respective cylinder bores 8 and the suction chamber 30, and a plurality of discharge ports 33 providing a communication between the respective cylinder bores 8 and the annular discharge chamber 31.

The suction ports 32 of the valve plate 4 are closed by suction valves (not shown) which can be moved to the opening position thereof when the respective pistons 9 carry out the suction stroke, and the discharge ports 33 of the valve plate 4 closed by discharge valves (not shown) which can be moved to the opening position thereof when the respective pistons 9 carry out the discharge stroke.

The cylinder block 1 and the front housing 2 are provided with a damping chamber 90 functioning as a muffling chamber for deadening pulsative components in discharge pressure of the refrigerant gas after compression. Namely, the damping chamber 90 fluidly communicates with the annular discharge chamber 31 through a discharge passage 91. The damping chamber 90 also communicates with the external refrigerating system via a discharge gas outlet port 92 in the form of a threaded hole formed in the cylinder block 1. The outlet port 92 is formed so as to be threadedly engaged with a suitable hose joint by which the damping chamber 90 communicates with the external refrigerating system via a fluid conduit means made of gas hose.

A valve receiving chamber 93 is arranged just adjacent to the damping chamber 90, and is formed in a bulged portion 94 of the cylinder block 1 in the form of a cylindrical bore extending substantially perpendicularly to the central axis of the cylinder block 1 running in parallel with the axis of rotation of the drive shaft 6. The valve receiving chamber 93 is provided for receiving a later-described capacity control valve 50.

The damping chamber 90 communicating with the discharge chamber 31 also communicates with a bottom portion of the bottomed valve chamber 43 through a passageway 97 (a second passageway) formed as a discharge pressure supply passageway running from the valve receiving chamber 93 toward the bottom portion of the bottomed valve receiving chamber 43.

The bottomed valve receiving chamber 43 receives a flow regulating valve 45 in the form of an axially movable spool type valve element operating so as to reduce the cross-sectional area of the ports 44 of the first passageway means in response to a change in the pressure of the refrigerant gas supplied through the discharge gas supply passageway 97. The spool type flow regulating valve 45 is constantly elastically urged by a spring 47 so as to be moved toward an initial position (a return position) thereof where the ports 44 establish a predetermined cross-sectional areas in the first passageway means. The spring 47 is arranged between a spring seat 46 provided at the rear end of the drive shaft 6 and the flow regulating valve.

A passageway 95 is provided for communicating between the crank chamber 5 and the valve receiving chamber 93 in order to detect a pressure prevailing in the crank chamber 5, and is fluidly connected to one of the ports of the capacity control valve 50.

Figure 4:
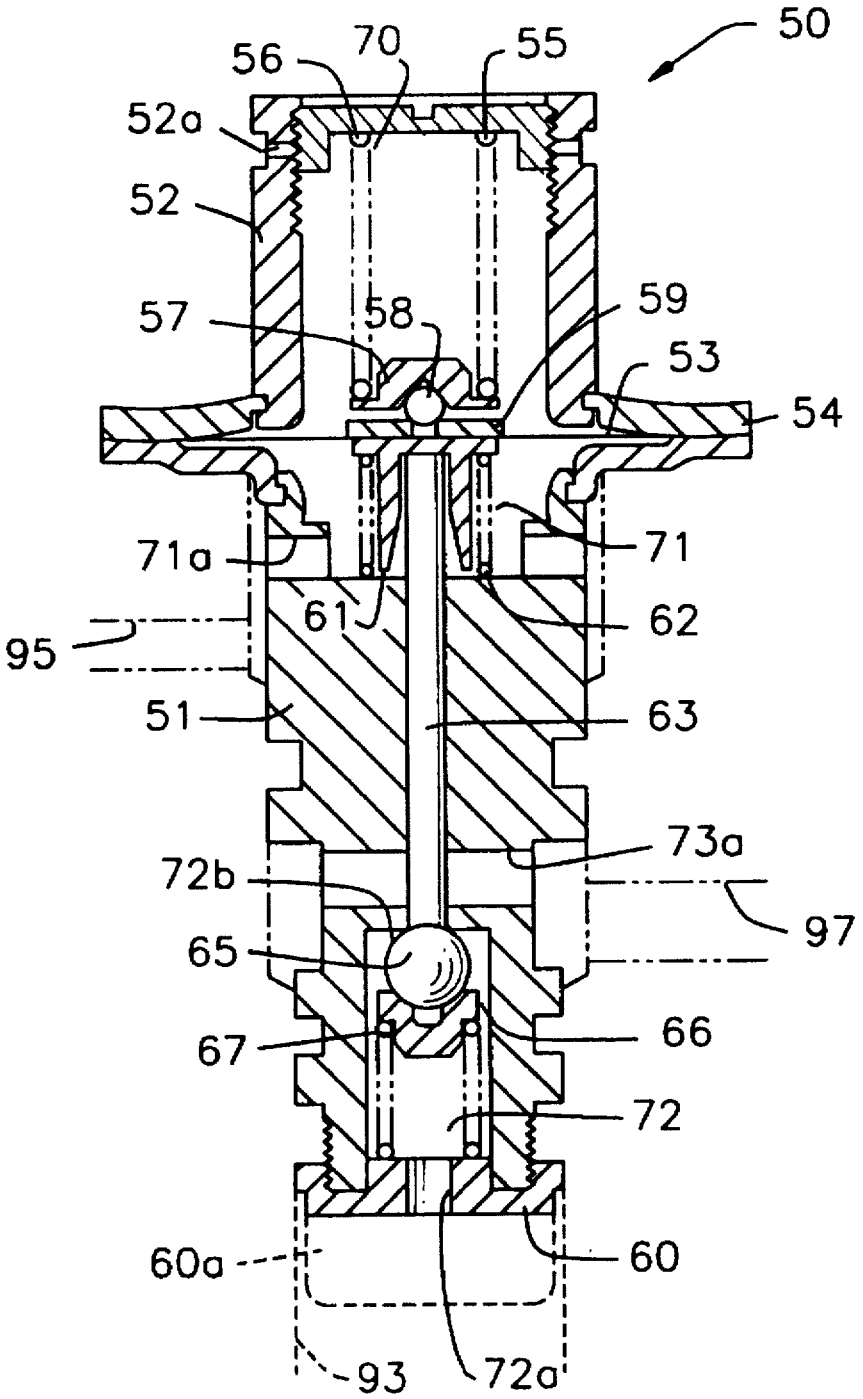
FIG. 4 is an enlarged cross-sectional view of a capacity control valve unit incorporated in the compressor of FIG. 1, illustrating the internal construction of the valve unit.

A description of the capacity control valve 50 is provided below with reference to FIG. 4.

The capacity control valve 50 includes a main body 51, a cylindrical head 52, and a diaphragm 53 held by a pair of holding members 54. The open end of the cylindrical head 52 is closed by a plug-like cap 55 threadedly engaged in the open threaded end of the head 52 so as to define an atmospheric chamber 70 enclosed by the plug-like cap 55, the diaphragm 53 and an upper one of the holding members 54. A plurality of radial holes **52*a* formed in the cylindrical head 52 is provided for communicating the atmospheric chamber 70 with the atmosphere via a slight air-gap remaining in the threadedly engaged portion of the plug-like cap 55 and the cylindrical head 52. Thus, the pressure in the atmospheric chamber 70 is constantly maintained at atmospheric pressure. In the atmospheric chamber 70, a flanged block element 57 is provided to have a flange portion on which one end of a compression coil spring 56 having a pre-designed spring constant rests, and the other end of the coil spring 56 is seated on the inner face of the plug-like cap 55. The flanged block element 57 is provided with an end face having a conical recess for receiving a single metallic ball element 58 which is engaged in a hole formed in an annular press metal 59 attached to the diaphragm 53. Thus, the diaphragm 53 constantly receives the atmospheric pressure and the pressure of the coil spring 56 at the face exposed to the atmospheric chamber 70**.

On the other hand, the other face of the diaphragm 53 is exposed to a suction pressure chamber 71 which is defined by a top end portion of the main body 51, a lower one of the holding members 54, and the diaphragm 53. The suction pressure chamber 71 fluidly communicates with the afore-mentioned pressure detecting passageway 95 (see FIG. 1) via a port **71*a* formed in the top end portion of the main body 51. Thus, the suction pressure chamber 71 is supplied with a pressure equivalent to the pressure prevailing in the crank chamber 5 (the crank chamber pressure). A cup-like pressing block 61 is provided in the suction chamber 71 so that it is pressed against the face of the diaphragm 53 by a predetermined spring force presented by a compression coil spring 62 arranged between the flange portion of the cup-like pressing block 61 and the bottom face of the suction chamber 71. A rod 63 slidably fitted in a central bore of the main body 51 has an end attached to cup-like pressing block 61**.

The main body 51 has a lower end portion defining a cylindrical discharge pressure chamber 72 in which a lower end of the rod 63 is exposed. The discharge pressure chamber 72 has an upper valve seat against which a ball valve 65 is seated, and a lower port **72*a* formed in an end plug 60 threadedly engaged with the lowermost threaded end of the main body 51. The lower port 72*a* communicates between the discharge pressure chamber 72 of the main body 51 and the afore-mentioned damping chamber 90 through the afore-mentioned valve receiving chamber 93. Thus, the discharge pressure chamber 72 is supplied with a pressure of the refrigerant gas after compression from the discharge chamber 31. A pressing element 66 is disposed in the discharge pressure chamber 72 so as to be pressed against the ball valve 65 at the predetermined spring force presented by a compression coil spring 67 arranged between the pressing element 66 and the end plug 60**.

The main body 51 is provided with a central port **73*a* formed therein at a position adjacent to the valve seat of the discharge chamber 72, and is fluidly connected to the afore-mentioned discharge gas supply passageway 97 and to the discharge chamber 72 via a valve aperture 72*b* opening toward the discharge chamber 72 via the above-mentioned valve seat and closed and opened by the ball valve 65. In FIG. 4, 60*a* designates a gas-filtering element covering the end plug 60**.

With the above-described construction of the variable capacity single-headed piston type compressor, when the operation of the compressor is stopped, pressure prevailing in the interior of the compressor is maintained at a level larger than a preset value so that the diaphragm 53 is displaced from an initial position toward the atmospheric chamber 70 due to a pressure differential between a pressure consisting of a combination of a pressure prevailing in the suction pressure chamber 71 of the control valve 50 and the spring force of the coil spring 62 and a pressure consisting of a combination of the atmospheric pressure and the spring force of the coil spring 56. Accordingly, the ball valve 66 is urged, via the rod 63, toward a position seated against the valve seat of the discharge pressure chamber 72 and closes the valve aperture **72*b*. Thus, the discharge gas supply passageway 97 communicating between the damping chamber 90 (FIG. 1) and the back of the valve chamber 43** is closed.

On the other hand, when the compressor is operated by connecting the drive shaft 6 to the power supply source via the solenoid clutch type transmission unit, the single-headed pistons 9 are reciprocated by a rotation-to-reciprocation converting unit including the rotor 10, the hinge mechanism K, the swash plate 12, and shoes 14, so that compression of the refrigerant gas is carried out.

At the initial stage of the compression operation of the compressor, the temperature of an object of refrigeration, such as an automobile compartment, is high and the pressure prevailing in the crank chamber 5 is maintained high. Therefore, the capacity control valve 50 takes a position where the discharge gas supply passageway 97 is closed by the ball valve 65. Accordingly, the spool type flow regulating valve 45 stays at its initial position where the predetermined cross-sectional area of the ports 44 is maintained so a pressure differential between the pressure prevailing in the crank chamber 5 and that prevailing in the suction chamber 30 is very small. Thus, the single-headed pistons 9 reciprocate at the maximum stroke thereof to implement the largest capacity operation of the compressor.

When the refrigerant gas has passed through the external refrigerating system, it enters the crank chamber 5 through the suction gas inlet port 40, and is subjected to a pulsation damping action within the crank chamber 5. The refrigerant gas subsequently flows toward the suction chamber 30 of the rear housing 3 via the first fluid passageway running through the cylinder block 1. Then, the refrigerant gas is immediately sucked into respective cylinder bores 8 via the suction valves. Therefore, the crank chamber 5 successively receives the refrigerant gas from the external refrigerating system. Thus, the crank chamber 5 is constantly filled with the refrigerant gas at a low temperature, which contains therein an oil mist to sufficiently and adequately lubricate the internal movable elements of the rotation-to-reciprocation converting element, within the crank chamber 5, and the internal walls of the respective cylinder bores 8. Therefore, the mechanical durability of the internal movable elements within the crank chamber is greatly increased.

Further, since the pressure in the crank chamber 5 is maintained at a pressure level substantially equal to a low suction pressure, the shaft seal unit (lip seal) 7*c* is subjected to the low pressure, and accordingly, the shaft seal unit 7*c* is prevented from generating heat during the rotation of the drive shaft 6. As a result, the shaft seal unit 7*c* can have a longer operation life.

The refrigerant gas compressed by the respective single-headed pistons 9 within the cylinder bores 8 is successively discharged from respective cylinder bores 8 into the discharge chamber 31 via the discharge ports 33 and the discharge valves (not shown in FIGS. 1 through 4). The compressed refrigerant gas discharged from the cylinder bores 8 flows from the discharge chamber 31 of the rear housing 31 into the damping chamber 90 through the discharge passage 91, and accordingly, pulsating components in the discharge pressure of the compressed refrigerant gas are attenuated in the damping chamber 90 due to the muffling function of the damping chamber 90. Thereafter, the compressed refrigerant gas is delivered to the external refrigerating system via the discharge gas outlet port 92 and the fluid conduit connected to the gas outlet port 92. The lubricating oil component mixed with the refrigerant gas is separated from the gas in the damping chamber 90 and is led to the crank chamber 5 though a non-illustrated oil passageway.

During the continuation of the full capacity compressing operation of the compressor, the temperature of the refrigerated object, i.e., the automobile passenger compartment is gradually lowered, resulting in a reduction in the pressure prevailing in the crank chamber 5 below a preset value. Therefore, the pressure in the suction pressure chamber 71 of the capacity control valve 50 communicating with the crank chamber 5 via the passageway 95 and the port 71*a* is in turn reduced. Thus, the diaphragm 53 of the capacity control valve 50 is displaced toward the suction pressure chamber 71 so as to move the ball valve 65 away from the valve seat and the valve aperture 72*b*, via the slidable rod 63. Accordingly, the discharge gas supply passageway 97 communicates with the discharge pressure chamber 72 of the capacity control valve 50, and therefore, the high pressure refrigerant gas within the discharge chamber 31 of the rear housing 31 flows toward the back of the bottomed valve receiving chamber 43, through the lower port 72*a*, the discharge pressure chamber 72, the valve aperture 72*b*, the central port 73*a*, and the discharge gas supply passageway 97. Thus, the spool type flow regulating valve 45 is moved forward so as to adjustably reduce the cross-sectional area of the ports 44 of the first fluid passageway. Namely, the regulation of flow of the refrigerant gas flowing from the crank chamber 5 into the suction chamber 30 is implemented by the spool type flow regulating valve 45. The ports 44 of the first fluid passageway including the plurality of through-hole-like passages 41, the central chamber 42 and the bottomed valve receiving chamber 43 function as a fluid choke, respectively. Therefore, the pressure prevailing in the suction chamber 30 becomes lower than the pressure prevailing in the crank chamber 5 generating a pressure differential therebetween. When the pressure differential increases, the swash plate 12 is moved to a position where the angle of inclination thereof is reduced, and the reciprocating stroke of each of the single-headed pistons 9 is simultaneously reduced. Thus, the operation of the compressor is changed to a smaller capacity operation.

After the continuation of the smaller capacity operation of the compressor, when the pressure prevailing in the crank chamber 5 is increased in response to an increase in the refrigerating load applied to the refrigerating system, the capacity control valve 50 closes the valve aperture 72*b* so as to disconnect the fluid communication between the discharge pressure chamber 72 and the discharge gas supply passageway 97. Therefore, the pressure acting on the back of the valve receiving chamber 43, i.e., the back of the spool type flow regulating valve 45 is reduced. Accordingly, the valve 45 is moved back by the pressure of the compression coil spring 47 so that the cross-sectional area of the ports 44 is gradually restored to the initial predetermined area.

It should be understood that since the above-mentioned reduction in the cross-sectional area of the ports 44 as well as the restoration of the cross-sectional area of the ports 44 to the initial predetermined area are carried out gradually and smoothly, the capacity of the compressor is smoothly reduced and increased without adversely affecting the drivability of the automobile.

Further, the pressure remaining in the discharge gas supply passageway 97 is permitted to escape into the first fluid passageway through a slide-fit gap left between the flow regulating valve 45 and the inner wall of the valve receiving chamber 43, and is eventually introduced into the suction chamber 30.

It will be understood from the foregoing description that the variable capacity single-headed piston type compressor of the first embodiment of the present invention can smoothly vary the capacity thereof in response to a change in the refrigerating load while successfully attenuating the pulsation component contained in the pressure of the refrigerant gas sucked into the crank chamber from the external refrigerating system due to the muffling function presented by the crank chamber.

In the described embodiment of FIGS. 1 through 4, the first fluid passageway functioning as a suction passageway is arranged at a radially central portion of the compressor body, from the viewpoint of reducing the size and weight of the entire compressor. However, the suction passageway may be arranged in the radially outer portion of the cylinder block and the rear housing as required.

Further, the suction and discharge chambers arranged in the rear housing of the compressor of the first embodiment illustrated in FIG. 1 may be changed in a manner such that the radial positional relationship between the suction and discharge chambers with respect to the central axis of the compressor body are mutually reversed from the illustrated positional relationship, as required.

Figure 5:
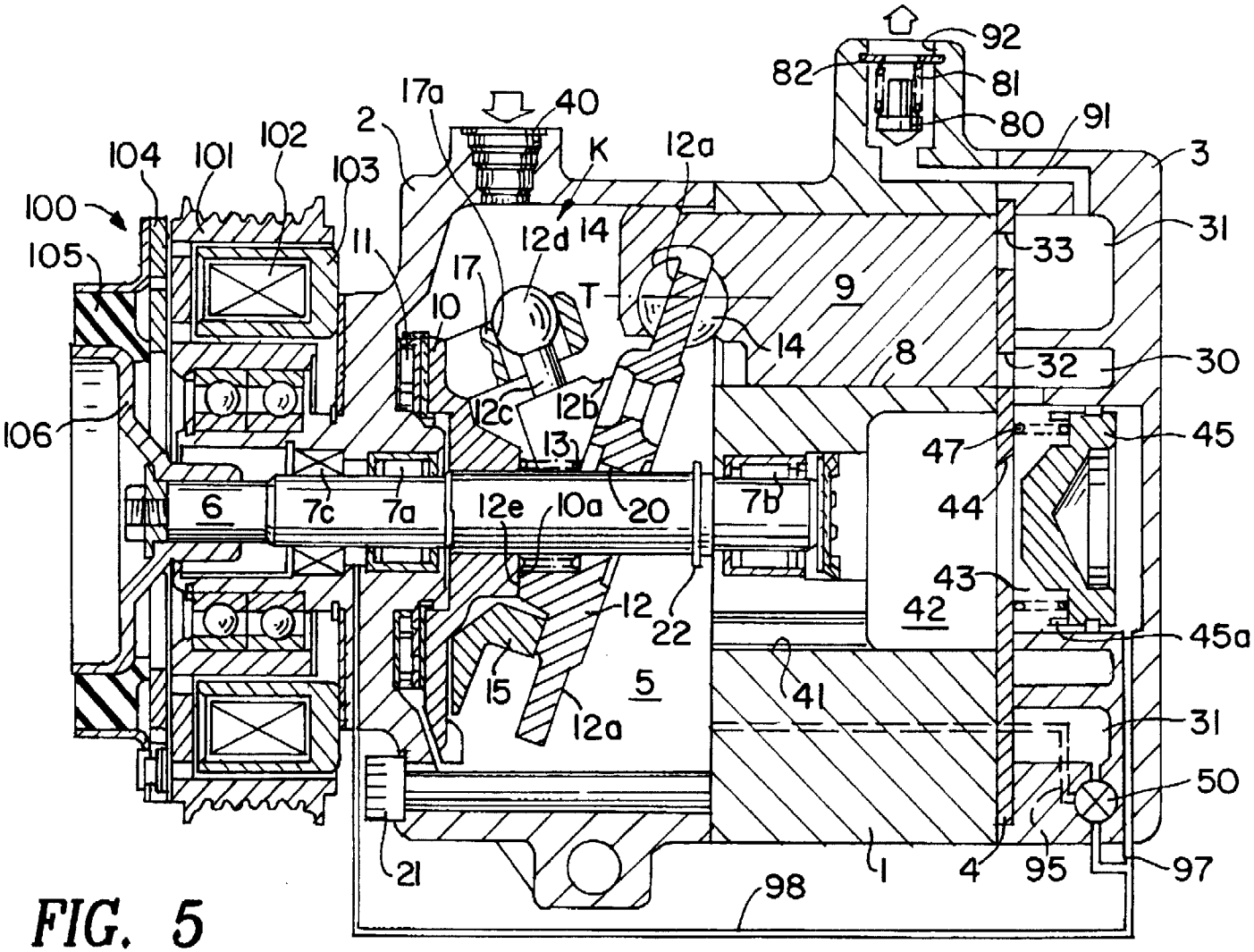
FIG. 5 is a longitudinal cross-sectional view of a variable capacity single-headed piston type refrigerant compressor according to another embodiment of the present invention.

FIG. 5 illustrates the internal construction of a variable capacity single-headed piston type compressor according to a second embodiment.

Similarly to the compressor of the first embodiment, the compressor of the second embodiment is provided with a suction gas inlet port 40 opening into the crank chamber 5.

The compressor of FIG. 5 is different from that of the first embodiment in that only a single port 44 formed in the valve plate 4 is provided in the first fluid passageway fluidly interconnecting between the crank chamber 5 and the suction chamber 30 for the suction of the refrigerant gas from the crank chamber into the suction chamber 30. Thus, the spool type flow regulating valve 45 is provided with a front conical end cooperating with the port 44 in order to control the cross-sectional area of a first fluid passageway including a plurality of through-hole-passages 41, a central chamber 42, and a bottomed valve chamber 43.

The discharge chamber 31 of the rear housing 3 fluidly communicates with a discharge gas supply passageway 97 (the second fluid passageway) via a capacity control valve 50, and the discharge gas supply passageway 97 extends toward the back of the bottomed valve chamber 43, so that a part of the refrigerant gas in the discharge chamber 31 is introduced into the back of the chamber 43 and applies the high pressure of the gas onto the recessed rear end of the spool type flow regulating valve 45 in response to the controlling operation of the capacity control valve 50. Namely, when the high pressure of the refrigerant gas acts on the rear end of the flow regulating valve 45, the valve 45 moves forward against the spring force of a returning spring 47 so as to reduce the cross-sectional area of the first fluid passageway. However, since the spool type flow regulating valve 45 is provided with stop pins 45*a* which are engaged with the end face of the valve plate 4 so as to stop the forward movement of the valve 45, and it establishes a predetermined small amount of cross-sectional area (the minimum cross-sectional area) in the first fluid passageway.

In the second embodiment, a third fluid passageway 98 is additionally arranged for providing a fluid communication between the discharge gas supply passageway 97 and the crank chamber 5. Namely, a part of the refrigerant gas after compression may flow from the discharge gas supply passageway 97 to the crank chamber 5. Namely, the refrigerant gas is permitted to return into the crank chamber 5. Nevertheless, the third fluid passageway 98 has a smaller cross-sectional area compared with that of the discharge gas supply passageway 97 in order that the passageway 97 accurately supplies the high pressure refrigerant gas to the back of the bottomed valve chamber 43 without being adversely affected by the third fluid passageway 98. The end of the third fluid passageway 98 is fluidly connected to a position adjacent to the shaft seal unit 7*c* mounted on the drive shaft 6 and sealing the front end of the crank chamber 5. It should be understood that although the passageway 98 is illustrated so as to be arranged outside the compressor body in FIG. 5, the passageway 98 is in fact arranged in the compressor body, e.g., in the front housing 2 and the cylinder block 1.

A fluid passageway 95 (a pressure detecting passageway) is arranged between the capacity control valve 50 and the crank chamber 5 so as to apply the pressure prevailing in the crank chamber 5 to a predetermined port of the capacity control valve 50 in the same manner as the fluid passageway 95 of the first embodiment as shown in FIG. 5.

The compressor of the second embodiment is provided with a discharge gas outlet port 92 which is different from the port 92 of the first embodiment. Namely, the compressor of the second embodiment is not provided with any chamber corresponding to the damping chamber 90 as shown in FIG. 1, and the discharge gas outlet port 92 is fluidly connected to the discharge chamber 31 via a differential pressure valve 80 and a discharge passage 91. The differential pressure valve 80 is urged by a spring 81, which is held between a spring seat 82 and a flange of the valve 80, toward a position closing a port formed in the discharge passage 91. However, the operation of the differential pressure valve 80 is designed in a manner as set forth below. Namely, while the external refrigerating system including the compressor continues its ordinary refrigerating operation, the pressure of the compressed refrigerant gas can overcome the spring force of the spring 81, and therefore, the differential pressure valve 80 opens the above-mentioned port of the discharge passage 91, and the compressed gas is delivered from the compressor toward the refrigerating system.

Nevertheless, when the refrigerating load applied to the refrigerating system is reduced to the minimum condition where the swash plate 12 is moved to a position at which the angle of inclination thereof is the smallest, slightly larger than the zero inclination-angle, and when the spool type flow regulating valve 45 is stopped at the smallest cross-sectional area position due to the engagement of the stops 45*a* with the valve plate 4, the discharge pressure of the compressed refrigerant gas is reduced to a level at which the spring force of the spring 81 overcomes the discharge pressure so that the differential pressure valve 80 is moved to the position closing the port of the discharge passage 91.

In FIG. 5, a solenoid clutch designated by reference numeral 100 is mounted on a flange portion formed in the front end of the front housing 2 via a anti-friction ball bearing. The solenoid clutch 100 includes a rotor 101 having a frictional end face and connected to an external drive power source such as an automobile engine via a belt, a stator 103 having a solenoid 102 therein and stationarily housed in an annular recess formed in the rotor 101, an armature 104 in the form of a flat plate facing the frictional face of the rotor 101, and a hub element 106 connecting the armature 104 to the drive shaft 6 of the compressor via a shock absorber 105.

When the drive shaft 6 is rotated by the drive power transmitted from the drive power source via the solenoid clutch 100, the compressor is initially brought into a full capacity operation. After the continuation of the full capacity operation of the compressor, a change in the refrigerating load applied to the external refrigerating system causes a change in pressure of the refrigerant gas introduced from the refrigerating system into the compressor via the suction gas inlet port 40. The change in the suction pressure of the refrigerant gas is detected by the capacity control valve 50 via the pressure detecting passageway 95, and accordingly, the control valve 50 controls the movement of the spool type flow regulating valve 45 by which a pressure differential is generated between the pressures in the crank chamber 5 and the suction chamber 30 so as to cause a change in the reciprocating stroke of the single-headed pistons 9 as well as a change in the angle of inclination of the swash plate 12. Thus, the capacity of the compressor is controlled in response to a change in the refrigerating load.

Further, when the refrigerating load is reduced to the minimum condition, and when the swash plate 12 is moved to the minimum inclination-angle position slightly larger than zero-angle position, the flow regulating valve 45 is moved forward to and stopped at the position where the cross-sectional area of the first fluid passageway for the suction of the refrigerant gas becomes the smallest. Thus, the pressure of the compressed refrigerant gas is reduced to a level where the differential pressure valve 80 is moved by the spring force of the spring 81 against the pressure of the compressed refrigerant gas, and closes the port in the discharge passage 91. Therefore, the delivery of the compressed refrigerant gas from the compressor toward the external refrigerating system via the discharge gas outlet port 92 is stopped. Accordingly, the refrigerant gas discharged from the respective cylinder bores 8 toward the discharge chamber 31 by reciprocation of the respective single-headed pistons 9 at the minimum reciprocation stroke is directly introduced into the crank chamber 5 via the capacity control valve 50 in its open position, the discharge gas supply passageway 97, and the third fluid passageway 98. The refrigerant gas entering the crank chamber 5 further flows toward the suction chamber 30 via the first fluid passageway including the single port 44 held at the minimum cross-sectional area condition, and is then sucked into the respective cylinder bores 8. Namely, the circulation of the refrigerant gas within the compressor, and the lubrication of the internal movable elements of the compressor, are continued.

It will be understood that in the compressor of the second embodiment, when the refrigerating load applied to the refrigerating system is reduced to the minimum whereat no more refrigeration is required, the flow of the refrigerant gas from the compressor toward and through the refrigerating system is stopped, and accordingly, frosting of an evaporator incorporating in the refrigerating system can be prevented. Further, the circulation of the refrigerant gas within the compressor contributes to lubrication of the internal elements of the compressor. Accordingly, it is possible to stop frequent connecting and disconnecting operations of the solenoid clutch type transmission unit 100, and therefore, the operation of the compressor does not adversely affect on the drivability of the automobile. It should, however, be noted that during driving of the automobile, if it is needed to intentionally stop the operation of the compressor and to intentionally restart the operation of the compressor, the operator may disconnect and reconnect the solenoid clutch type transmission unit 100.

Figure 6:
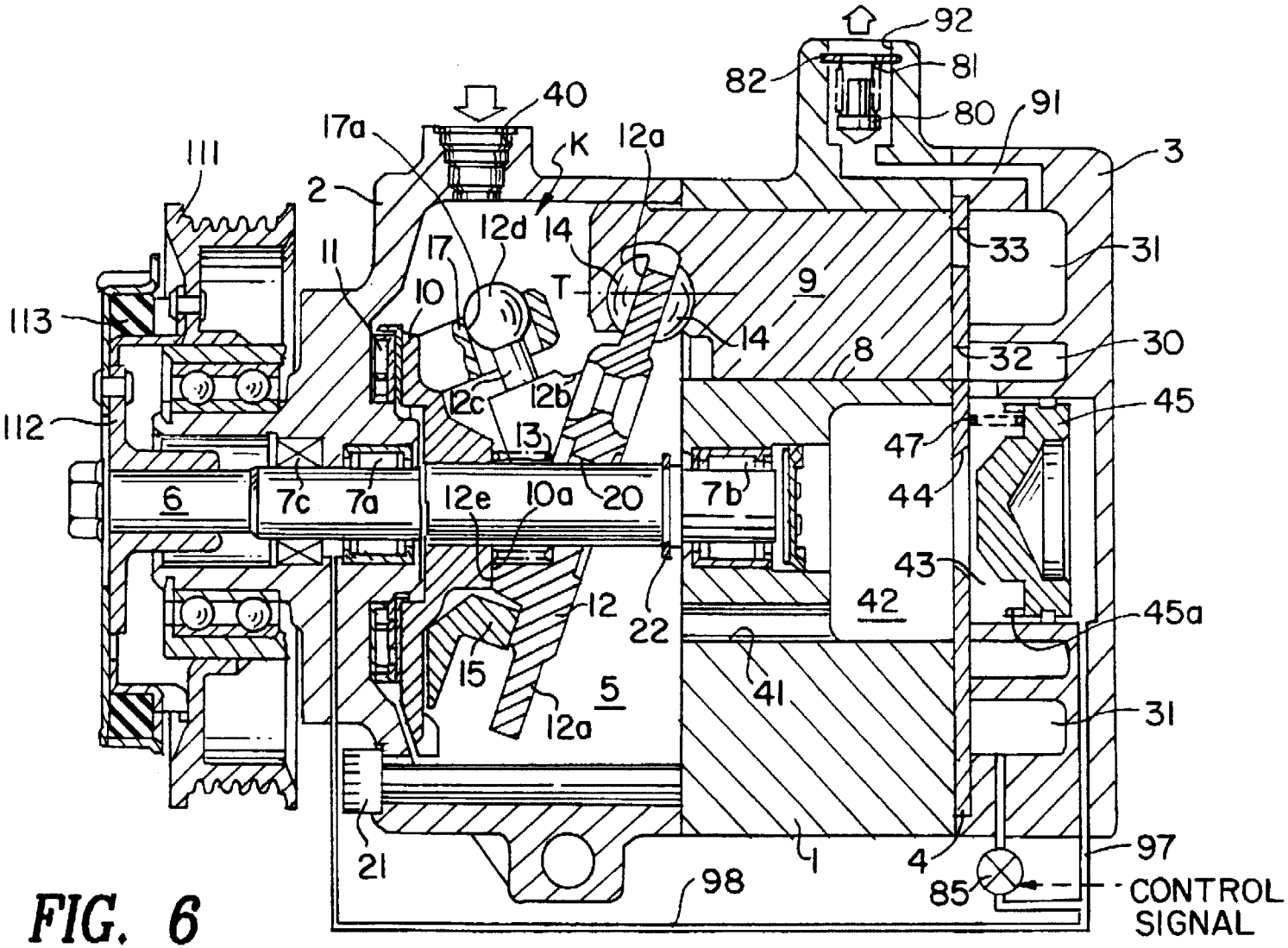
FIG. 6 is a longitudinal cross-sectional view of a variable capacity single-headed piston type refrigerant compressor according to a further embodiment of the present invention.

FIG. 6 illustrates a variable capacity single-headed piston type compressor according to a third embodiment of the present invention. The internal construction of the compressor is similar to those of the first and second embodiments except for certain characteristic features as set forth below.

Referring to FIG. 6, the compressor is provided with a non-clutch type transmission unit mounted on the front end of the front housing 2 of the compressor. The transmission unit includes a pulley 111 mounted on a flange portion formed in the front end of the front housing 2 via anti-friction bearing. The pulley 111 is connected to a drive power source such as an automobile engine (not shown) via a suitable belt, and the rotation of the pulley 111 is transmitted constantly and directly to the drive shaft 6 of the compressor via a hub element 112 and a shock absorber 113.

The compressor is further characterized in that it is provided with an ON-OFF solenoid valve 85 which is incorporated in a discharge gas supply passageway 97, for controlling the opening and closing of a valve port formed in the passageway 97. The discharge gas supply passageway 97 corresponds to the passageway 97 of the first and second embodiments, and is provided for supplying the pressure of the compressed refrigerant gas from the discharge chamber 31 of the rear housing 3 to the back of the bottomed valve chamber 43 of the first fluid passageway (a suction passageway). Namely, in the compressor of the third embodiment, the afore-described capacity control valve 50 is replaced with the above-mentioned ON-OFF type solenoid valve 85. The solenoid valve 85 is so designed that when the compressor is performing its ordinary compressing operation to deliver the compressed refrigerant gas toward the external refrigerating system, the solenoid valve 85 is kept at a closing position thereof by an ON control signal supplied from, for example, a control panel of an automobile, and it is shifted to an opening position thereof by an OFF control signal supplied from the same control panel.

When the compressor is performing a full capacity operation, and when the solenoid valve 85 is switched from the closing position to the opening position by the impression of the OFF control signal, the pressure of the compressed refrigerant gas is supplied from the discharge chamber 31 to the back of the bottomed valve chamber 43 so as to move the spool type flow regulating valve 45 toward a position reducing the cross-sectional area of the port 44 of the first fluid passageway. Thus, in response to a reduction in the refrigerating load applied to the refrigerating system, the flow regulating valve 45 is gradually moved to the position where the smallest cross-sectional area of the port 44 is established due to an engagement of the stops **45*a* with the valve plate 4, and at this stage, the swash plate 12 is shifted to the minimum inclination-angle position slightly inclining from the zero inclination-angle position where the angle of inclination of the swash plate 12 is perpendicular to the axis of rotation of the drive shaft 6. Accordingly, the differential pressure valve 80 closes the discharge passage 91 so as to prevent delivery of the compressed refrigerant gas from the compressor toward the external refrigerating system. Thus, the compressed refrigerant gas discharged from the cylinder bores 8 toward the discharge chamber 31 is returned directly to the crank chamber 5 via the solenoid valve 85 and the third fluid passageway 98. The refrigerant gas then flows toward the suction chamber 30 from the crank chamber 5 via the port 44 of the first fluid passageway which is reduced to the minimum cross-sectional area condition, and is subsequently sucked into the respective cylinder bores 8**. Therefore, the refrigerant gas is circulated within the compressor body. Accordingly, the internal elements of the compressor can be lubricated by the oil component contained in the circulating refrigerant gas.

It should be understood that since the compressor of FIG. 6 is provided with the solenoid valve 85 in place of the above-described capacity control valve 50, the capacity control function in an intermediate capacity range is made invalid. Nevertheless, the omission of the capacity control valve can contribute to a reduction in the manufacturing cost of the compressor compared with the compressors of the first and second embodiments.

Figure 7:
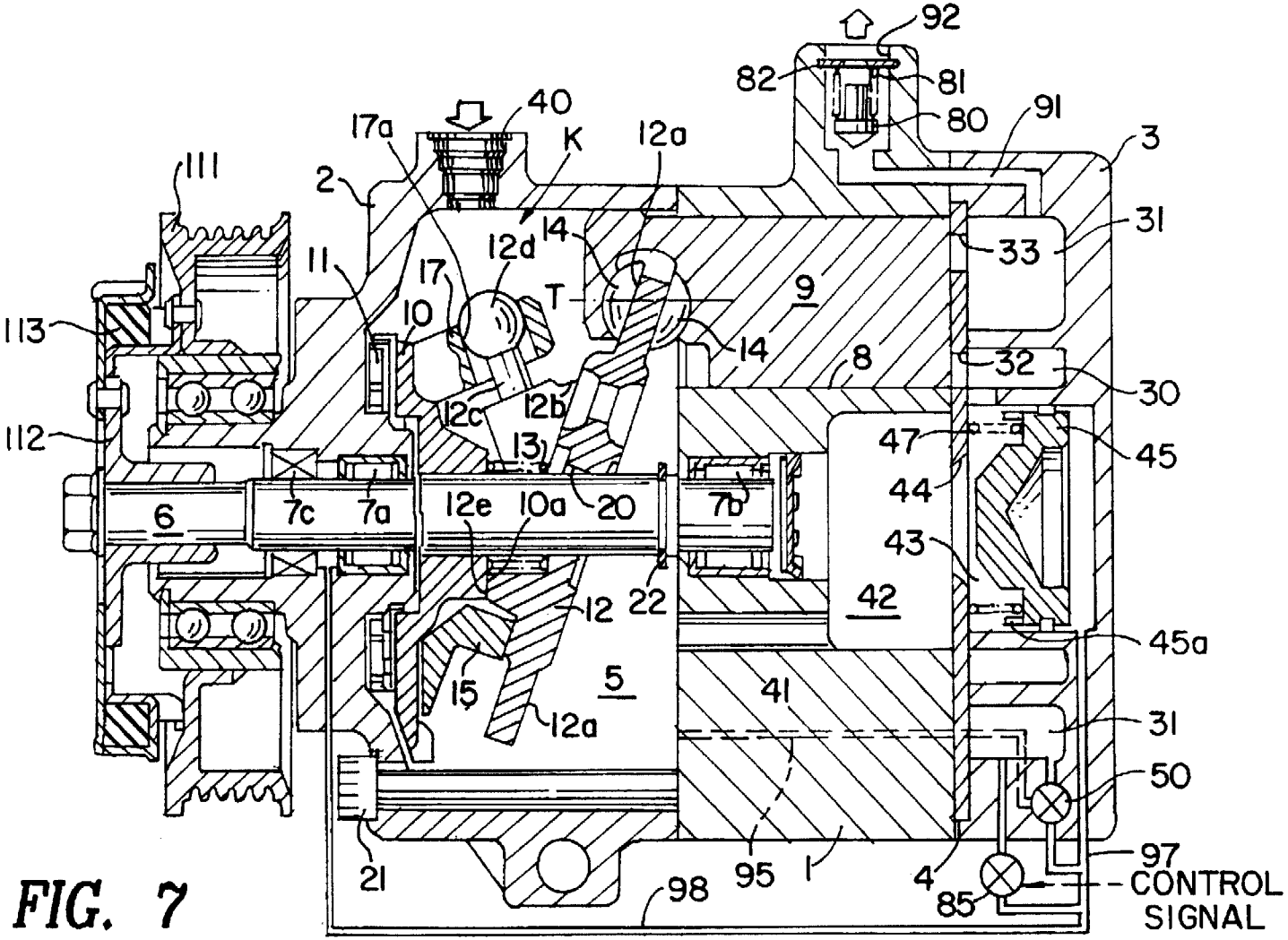
FIG. 7 is a longitudinal cross-sectional view of a variable capacity single-headed piston type refrigerant compressor modified from the compressor of FIG. 6.

FIG. 7 illustrates a variable capacity single-headed piston type compressor according to a modification of the third embodiment of FIG. 6.

The compressor of FIG. 7 is modified from the compressor of FIG. 6 in that a capacity control valve 50 and a solenoid valve 85 are arranged so as to cooperate with one another in order to improve the control characteristic of the compressor at an intermediate capacity operation thereof. Thus, the compressor can be operated so that the capacity control of the compressor can be smoothly achieved over the entire capacity range from a small to a large capacity and vice versa. Further, irrespective refrigerating load applied to the refrigerating system, it is possible to stop the delivery of the compressed refrigerant gas from the compressor by moving the solenoid valve 85 to its open position.

Preferably, the solenoid valve 85 and the capacity control valve 50 are assembled into an integral unit and are built in a suitable internal portion of the compressor body.

From the foregoing description of the preferred embodiments of the present invention, it will be understood that since a variable capacity single-headed piston type refrigerant compressor is provided with a crank chamber supplied with the suction refrigerant gas at a low temperature and containing a lubricating oil component, the internal movable elements of the compressor can be constantly cooled and lubricated. Thus, the operation reliability and life of the compressor can be remarkably increased. Particularly, the operation durability of the shaft seal unit mounted on the front end portion of the drive shaft for sealing the front side of the crank chamber of the compressor can be increased. Further, the crank chamber having a large volume can contribute to an attenuation of the pulsative components in the suction pressure of the refrigerant gas and, accordingly, the noise due to the pulsation of pressure of the refrigerant gas can be suppressed.

Further, according to the present invention, when the variable capacity single-headed piston type compressor is used with a refrigerating system for an automobile, the compressor can be operated so as to vary the capacity thereof smoothly in response to a change in a refrigerating load applied to the refrigerating system. Thus, the drivability of the automobile can be greatly improved. The use of the non-clutch type solenoid clutch further contributes to the improvement in the drivability of the automobile.

Still further, the variable capacity single-headed piston type compressor according to the present invention can prevent an evaporator of the refrigerating system from frosting. Accordingly, the operational reliability of the refrigerating system can be enhanced.

Since the variable capacity single-headed piston type compressor of the present invention can be used with a non-clutch type transmission unit, it is possible to reduce manufacturing cost of the entire refrigerating system including the compressor.

Many modifications and variations will occur to persons skilled in the art without departing from the spirit and scope of the invention claimed in the accompanying claims.

We claim:

1. A variable capacity single-headed piston type compressor suitable for being incorporated in an external refrigerating system comprising:

a cylinder block having axial front and rear ends and defining a plurality of axial cylinder bores therein around a central axis thereof;

a front housing hermetically attached to said front end of said cylinder block so as to define a crank chamber therein;

a rear housing hermetically attached to said rear end of said cylinder block so as to define therein a suction chamber for a refrigerant gas before compression and a discharge chamber for said refrigerant gas after compression;

an axial drive shaft rotatably supported in said front housing and said cylinder block to be rotated about an axis of rotation thereof, said axial drive shaft having a front end receiving a drive power thereat;

a plurality of single-headed pistons slidably received in said plurality of cylinder bores for implementing suction, compression and discharge of said refrigerant gas;

a rotation-to-reciprocation converting plate-like means arranged to be rotated together with said drive shaft and provided with a plate portion angularly inclined from a plane perpendicular to said axis of rotation of said axial drive shaft, wherein the angle of inclination thereof can change in response to a change in a differential between pressures prevailing in said crank chamber and said suction chamber, said rotation-to-reciprocation converting plate-like means being operatively connected to said plurality of single-headed pistons to thereby generate reciprocation of said pistons;

a suction gas inlet means for providing a fluid connection between said crank chamber and said external refrigerating system so as to introduce said refrigerant gas, before compression, directly into said crank chamber from said external refrigerating system;

a discharge gas outlet means for providing a fluid connection between said discharge chamber and said external refrigerating system so as to deliver said refrigerant gas, after compression, to said refrigerating system;

a fluid passageway means extending between said crank chamber and said suction chamber for providing a constant fluid connection therebetween, said fluid passageway means including at least one port portion formed therein to have a predetermined cross-sectional area; and a flow regulating valve means disposed in said fluid passageway means and cooperating with said port portion of said fluid passageway means so as to regulate said cross-sectional area of said port portion with respect to said predetermined cross-sectional area thereof to thereby adjustably change the pressure prevailing in said suction chamber.

2. A variable capacity single-headed piston type compressor according to claim 1, further comprising a pressure-responsive capacity control valve means therein having a constant fluid interconnection with said discharge chamber of said rear housing, and controls, a differential between a pressure in said crank chamber and a pressure in said suction chamber in response to a change in the refrigerating load applied to said external refrigerating system.

3. A variable capacity single-headed piston type compressor according to claim 2, wherein said pressure-responsive capacity control valve means is fluidly connected to said flow regulating valve means so as to apply the pressure of said refrigerant gas, after compression, to said flow regulating valve means to thereby actuate said flow regulating valve means in such a manner that said pressure prevailing in said suction chamber is adjustably changed in response to said change in said refrigerating load.

4. A variable capacity single-headed piston type compressor according to claim 1, wherein said flow regulating valve means comprises a spool valve element movably arranged adjacent to said port portion of said fluid passageway means and having a pressure receiving end thereof for receiving said pressure of said refrigerant gas, after compression, said spool valve element adjustably changing said cross-sectional area of said port portion of said fluid passageway means with respect to said predetermined cross-sectional area thereof.

5. A variable capacity single-headed piston type compressor according to claim 1, further comprising an additional fluid passage means arranged internally between said pressure-responsive capacity control valve means and said crank chamber, for circulating a part of said refrigerant gas after compression from said discharge chamber into said crank chamber via said pressure-responsive capacity control valve means.

6. A variable capacity single-headed piston type compressor according to claim 1, wherein said discharge gas outlet means preferably comprises a differential-pressure-operated valve means which prevents said refrigerant gas, after compression, from flowing from said discharge chamber toward said external refrigerating circuit when said rotation-to-reciprocation converting plate-like means is moved to a position whereat the reciprocating stroke of each of said plurality of single-headed pistons is at said minimum stroke thereof.

7. A variable capacity single-headed piston type compressor according to claim 1, wherein said rotation-to-reciprocation converting means comprises a rotating swash plate type rotation-to-reciprocation converter including a swash plate element rotating together with said drive shaft and operatively connected to said respective pistons via respective shoe elements.

8. A variable capacity single-headed piston type compressor according to claim 1, wherein said first fluid passageway is formed so as to extend through said cylinder block.

9. A variable capacity single-headed piston type compressor according to claim 1, further comprising a damping chamber means formed in said front housing and said cylinder block so as to fluidly communicate with said discharge chamber to thereby receive said refrigerant gas, after compression, and to attenuate the pulsative components contained in the pressure of said refrigerant gas after compression.

10. A variable capacity single-headed piston type compressor according to claim 1, wherein said suction chamber is arranged radially inside said discharge chamber, and said first fluid passageway is arranged in a central portion of said cylinder block and said rear housing and around said axis of rotation of said drive shaft.

11. A variable capacity single-headed piston type compressor suitable for being incorporated in an external refrigerating system comprising:

a cylinder block having axial front and rear ends and defining a plurality of axial cylinder bores therein around a central axis thereof;

a front housing hermetically attached to said front end of said cylinder block so as to define a crank chamber therein;

a rear housing hermetically attached to said rear end of said cylinder block so as to define therein a suction chamber for refrigerant gas, before compression, and a discharge chamber for said refrigerant gas after compression;

an axial drive shaft rotatably supported in said front housing and said cylinder block and rotatable about an axis of rotation thereof, and having a front end to receive drive power;

a plurality of single-headed pistons slidably received in said plurality of cylinder bores to implement suction, compression and discharge of said refrigerant gas;

a rotation-to-reciprocation converting plate-like means arranged to be rotated together with said drive shaft and provided with a plate portion angularly inclined from a plane perpendicular to said axis of rotation of said axial drive shaft, and its angle of inclination thereof being changeable in response to a change in a differential between the pressures prevailing in said crank chamber and said suction chamber, said rotation-to-reciprocation converting plate-like means being operatively connected to said plurality of single-headed pistons so as to reciprocate said pistons;

a suction gas inlet means for providing a fluid connection between said crank chamber and said external refrigerating system so as to introduce said refrigerant gas before compression directly into said crank chamber from said external refrigerating system;

a discharge gas outlet means for providing a fluid connection between said discharge chamber and said external refrigerating system so as to deliver said refrigerant gas, after compression, to said refrigerating system;

a first fluid passageway internally extending between said crank chamber and said suction chamber for providing a constant fluid connection therebetween, said first fluid passageway including at least one port portion formed therein to have a predetermined cross-sectional area; and a spool type flow regulating valve disposed movably in said first fluid passageway and cooperating with said port portion of said first fluid passageway so as to adjustably reduce said cross-sectional area of said port portion with respect to said predetermined initial cross-sectional area thereof to thereby adjustably change a pressure prevailing in said suction chamber, said spool type flow regulating valve having a mechanical means for stopping the movement thereof at a position where said port portion has a predetermined reduced cross-sectional area with respect to said initial cross-sectional area;

a solenoid valve arranged in a second fluid passage way extending between said discharge chamber and said spool type flow regulating valve for controlling a supply of a pressure of said refrigerant gas, after compression, from said discharge chamber toward said spool type flow regulating valve in response to a control signal provided by said external refrigerating system;

a third fluid passageway extending between said second fluid passageway and said crank chamber, for providing a fluid communication between said discharge chamber and said crank chamber via said solenoid valve; and a differential-pressure-operated valve means arranged in said discharge gas outlet means, for preventing said refrigerant gas, after compression, from flowing from said discharge chamber toward said external refrigerating circuit when said rotation-to-reciprocation converting plate-like means is moved to a position whereat the reciprocating stroke of each of said plurality of single-headed pistons is at said smallest stroke thereof.

12. A variable capacity single-headed piston type compressor according to claim 11, further comprising a pressure-responsive capacity control valve arranged in said second fluid passageway for supplying said pressure of said refrigerant gas, after compression, to said spool type flow regulating valve in response to a change in refrigerating load applied to said external refrigerating system.

13. A variable capacity single-headed piston type compressor according to claim 11, wherein said third fluid passageway is provided with two opposite ends, one being connected to said second fluid passageway adjacent to said solenoid valve, and said other end being connected to said crank chamber at a position adjacent to a shaft seal unit mounted on said axial drive shaft and fluidly sealing said crank chamber.

14. A variable capacity single-headed piston type compressor according to claim 11, wherein said first fluid passageway is formed so as to extend through said cylinder block.

15. A variable capacity single-headed piston type compressor according to claim 11, wherein said suction chamber is arranged radially inside said discharge chamber, and said first fluid passageway is arranged in a central portion of said cylinder block and said rear housing and around said axis of rotation of said drive shaft.

16. A variable capacity single-headed piston type compressor according to claim 11 wherein a non-clutch type transmission means is provided for constantly transmitting the drive power from an external drive source to said front end of the drive shaft.

* * * * *